US007507017B2

(12) United States Patent
Chevalier et al.

(10) Patent No.: US 7,507,017 B2
(45) Date of Patent: Mar. 24, 2009

(54) WRISTWATCH WITH A REVERSIBLE CASE

(75) Inventors: Jérôme Chevalier, Le Locle (CH); Dominique Ruggiero, La Mouille (FR)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/857,749

(22) Filed: Sep. 19, 2007

(65) Prior Publication Data

US 2008/0068933 A1 Mar. 20, 2008

(30) Foreign Application Priority Data

Sep. 19, 2006 (EP) ..... 06120862

(51) Int. Cl.
*G04B 37/00* (2006.01)
*A44C 5/00* (2006.01)

(52) U.S. Cl. ..... 368/281; 368/282

(58) Field of Classification Search ..... 368/88, 368/223, 281, 282, 309; 224/164, 167
See application file for complete search history.

(56) References Cited

U.S. PATENT DOCUMENTS 1,930,416 A * 10/1933 Chauvot ..... 368/281
4,236,239 A * 11/1980 Imgruth et al. ..... 368/72
4,444,513 A * 4/1984 Proellochs et al. ..... 368/223
4,493,561 A * 1/1985 Bouchet ..... 368/281
4,597,138 A 7/1986 Hirsch
6,738,317 B2 * 5/2004 Nussbaum ..... 368/88
6,779,917 B1 * 8/2004 Chappuis ..... 368/282
2006/0018202 A1 * 1/2006 Girardin et al. ..... 368/281
2006/0126445 A1 * 6/2006 Bouille ..... 368/281
2006/0171261 A1 * 8/2006 Ruchonnet ..... 368/281

FOREIGN PATENT DOCUMENTS

CH 172421 1/1935
CH 659167 A3 1/1987

OTHER PUBLICATIONS

European Search Report issued in corresponding application No. EP 06 12 0862 completed Apr. 2, 2007.

* cited by examiner

*Primary Examiner*—Vit W Miska
(74) *Attorney, Agent, or Firm*—Griffin & Szipl, P.C.

(57) ABSTRACT

The wristwatch with a reversible case (12) is provided with a wristband, each end strand of which includes an insert (30) which is pivotably and slidably mounted on the case (12) via a trunnion (32). Each insert (30) includes at least two indexed angular positions, which respectively correspond to two positions of use of the case (12), and at least one longitudinal rest position wherein the insert (30) is blocked from pivoting by a male element (36) fitting inside a female element (38), one of the elements (36) being arranged on the case (12), the other element (38) being arranged on the insert (30), and a longitudinal pivoting position wherein the insert (30) is shifted longitudinally outwards and wherein the insert (30) is free to pivot. The invention is characterized in that each trunnion (32) includes a first indexing element (48), which cooperates with a second indexing element (64, 66) arranged on the case (12) so as to index the insert (30) longitudinally.

14 Claims, 3 Drawing Sheets

WRISTWATCH WITH A REVERSIBLE CASE

This application claims priority from European Patent Application No. 06120862.5 filled Sep. 19, 2006, the entire disclosure of which is incorporated herein by reference.

FIELD OF THE INVENTION

The invention concerns a wristwatch with a reversible case.

The invention concerns more specifically a wristwatch comprising a reversible case that contains at least one watch movement, wherein each end strand of the wristband or bracelet includes an insert which is pivotably mounted on the reversible case via a longitudinal trunnion, along the direction of the wristband, and wherein each insert includes at least two indexed angular positions, relative to the case, which respectively correspond to two positions of use of the case, wherein each insert has:

- a longitudinal rest position wherein the insert is blocked from pivoting by a male element fitting inside a female element, one of the elements being arranged on the case, the other element being arranged on the insert, and
- a longitudinal pivoting position wherein the insert is shifted longitudinally outwards, relative to the case, and wherein the insert is free to pivot relative to the case.

BACKGROUND OF THE INVENTION

U.S. Pat. No. 4,597,138 discloses and shows a watch of this type wherein the male element is formed by a cylindrical pin fixed onto the horns of the case and the female element is formed by a concave cylindrical groove which forms the inner face of the insert. The insert is assembled on the cylindrical pin by means of a screw that is screwed into a threaded hole of the cylindrical pin and which forms the trunnion for the relative pivoting of the case in relation to the wristband. A return spring is inserted between the head of the screw and the outer surface of the insert so as to draw the insert towards its rest position. Thus, in order to pass to the pivoting position, a longitudinal force must be exerted outwards, against the return effort of the spring.

The rest position locking system provided in this Patent is not completely satisfactory since it is obtained by the return force of the spring. Consequently, when the spring is insufficiently stiff, this makes locking unreliable, which leads to a risk of inadvertent pivoting, particularly following an abrupt wrist movement by the user of the watch.

Moreover, the rest and pivoting positions are not precisely defined since the rest position towards the case is delimited solely by the insert abutting against the cylindrical pin or against the sheath that covers the same, and the pivoting position towards the exterior of the case is delimited solely by the total compression of the spring. Consequently, the user who manipulates this wristwatch in order to pivot the case feels some imprecision in the assembly of the parts. This imprecision may also worsen as the parts wear causing additional play in the assembly.

It is a particular object of the invention to overcome these drawbacks by proposing a simple and economical solution.

SUMMARY OF THE INVENTION

Therefore, the invention proposes a wristwatch of the previously described type, characterized in that each trunnion comprises a first longitudinal indexing element which cooperates with a second longitudinal indexing element arranged on the case so as to index the associated insert respectively in the rest position and in the pivoting position.

Owing to this feature, the function of turning the case over relative to the wristband is more reliable. Moreover, the manufacturing and assembly quality perceived by the user when he manipulates the wristwatch in order to turn the case over, is improved since the two longitudinal positions of the insert relative to the case are precisely defined in both directions.

According to an advantageous embodiment, the trunnion includes a securing section which is fixed in the insert and a cylindrical indexing section which extends longitudinally inside the case and which includes at least one first and one second transverse notches, offset longitudinally, which cooperate by nested fitting with at least one elastically deformable strip fixed inside the case so as to index the associated insert respectively in the rest position and in the pivoting position. The case includes a plate that extends overall in a transverse plane perpendicular to the longitudinal direction. The plate is secured to the case via the transverse ends thereof, and it includes a transverse slot, which delimits first and second deformable strips, at least one strip being received in one of the two notches when the insert is occupying an indexed position. This embodiment has the advantage of being particularly compact and simple to construct. Moreover, the notches thus provide an indexing effect for the angular positions corresponding to the positions of use of the case.

Preferably, the indexing section includes, for each indexed longitudinal position, a top notch and a bottom notch which are diametrically opposite and which each receive an associated strip when the insert is occupying the corresponding indexed position. More precise indexing is thus obtained since the trunnion is indexed in the upper part and lower part thereof, which limits play in the assembly.

According to an advantageous feature, the plate is secured in a groove arranged in the inner face of the middle part of the case. The compactness of the hinging device for turning over and indexing the case is thus improved, since on the case side, all of the elements are housed within the thickness of the peripheral transverse wall.

According to another advantageous feature, the nested fitting element for locking the insert, which is arranged on the case, is made integral with the case, which facilitates manufacture of the wristwatch by limiting the number of distinct parts and which improves the pivoting blocking quality.

Preferably, it is the male element that is made integral with the case in the form of a rib of overall rectangular section arranged on the external peripheral face of the case, the female element being made in the form of a complementary groove arranged in the face of the insert located opposite the case, which provides reliable locking without adversely affecting compactness, and which facilitates integration of the nested fitting elements in the case and in the insert.

Advantageously, the case includes a longitudinal cylindrical guide conduit, whose diameter is substantially equal to the external diameter of the trunnion and which guides the trunnion as it slides longitudinally. Moreover, the trunnion includes a cylindrical guide section that extends at least partially into the guide conduit, whatever indexed position is occupied by the insert. These features improve the assembly quality of the wristwatch elements and the reliability of the hinging device for turning the case over. Preferably, the trunnion includes a sealing gasket which is mounted in a peripheral annular groove inserted longitudinally between the guide section and the indexing section.

Preferably, the guide conduit extends through the male element, which further improves the compactness of the hinging device by grouping together several functions in the same location on the case.

According to another advantageous feature, each end strand of the wristband includes two horns which are fixed onto the insert, which provides a wristwatch with a conventional appearance, the hinging device being concealed.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE ILLUSTRATIVE EMBODIMENTS

Figure 1:
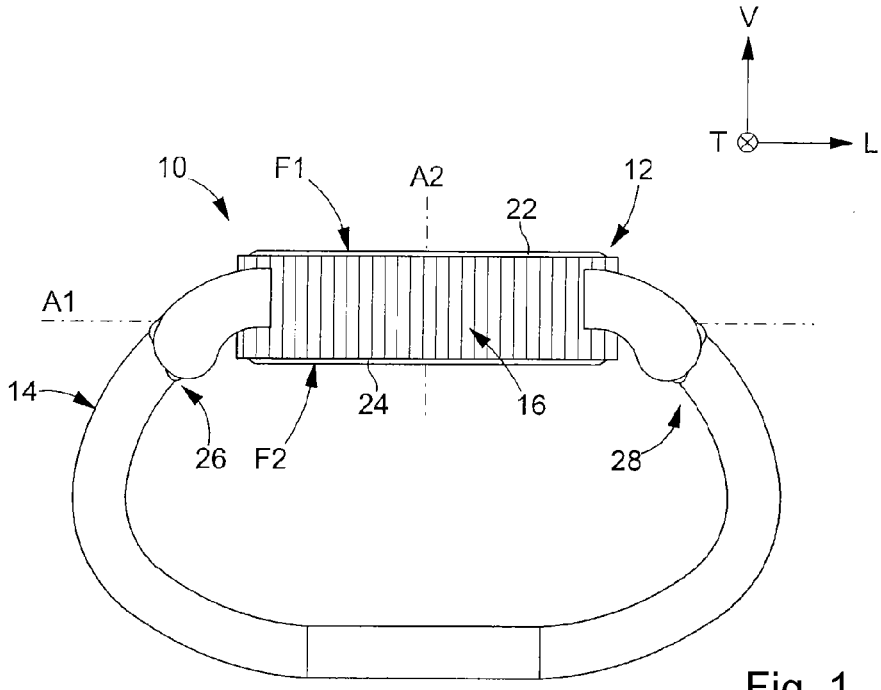
FIG. 1 is a side view that shows schematically a wristwatch with a reversible case in accordance with the teaching of the invention.
Figure 2:
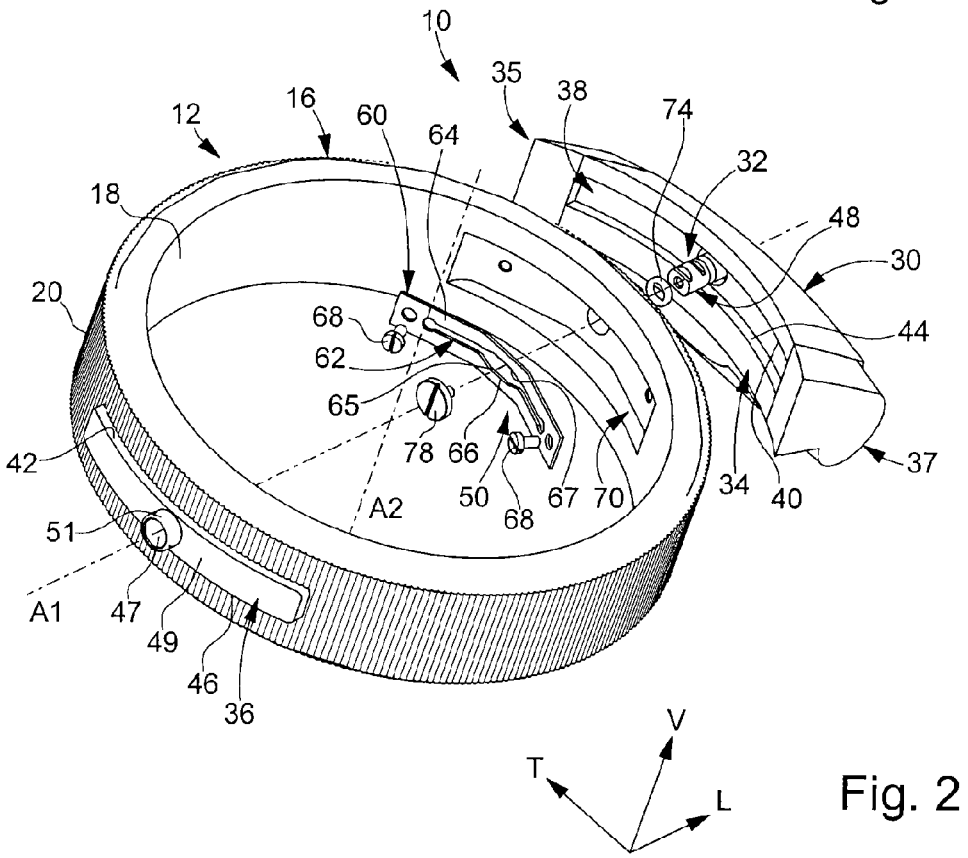
FIG. 2 is an exploded perspective view that shows schematically a pivoting and indexing device fitted to the wristwatch of FIG. 1.

In the following description, an orthogonal marking system V, L, T will be used, respectively defining the vertical V, longitudinal L and transverse T directions. Similar or identical elements may be designated by the same references.

FIGS. 1 to 6 show schematically a wristwatch 10 with a reversible case 12, which is made in accordance with the teaching of the invention. Case 12 is intended to contain at least one watch movement (not shown) and associated display means (not shown). It is pivotably mounted, relative to a wristband 14, about a longitudinal pivoting axis A1, this longitudinal direction corresponding overall to the direction of wristband 14.

In the following description, in a non-limiting manner, elements will be qualified as internal or external depending upon their orientation relative to case 12.

According to the embodiment shown, case 12 is formed by an overall cylindrical middle part 16 of vertical axis A2 which includes an inner axial wall 18 and an external peripheral axial wall 20. Middle part 16 is closed at an axial end, the top end in FIG. 1, by a first cover 22 corresponding to the right side F1 of wristwatch 10, and at the other axial end, the bottom end in FIG. 1, by a second cover 24 corresponding to the reverse side F1 of wristwatch 10.

Each cover 22, 24 is made, for example, in the form of a transparent protective crystal which allows an observer to see inside case 12, in particular to see the indications displayed by the display means. Of course, one of covers 22, 24 could also be made differently from the other, particular in the form of a metallic back cover.

Wristband 14 is secured to case 12 by its two end strands 26, 28 which are diametrically opposite relative to the axis A2 of case 12 along the pivoting axis A1. Thus, each end strand 26, 28 includes an insert 30 which is pivotably and slidably mounted on case 12, by a longitudinal trunnion 32. Wristband 14 may be made, for example, in the form of a leather or rubber strap fixed to inserts 30, for example by bonding, or in the form of a chain of metal links hinged on inserts 30.

According to the embodiment shown, each insert 30 has an overall parallelepiped shape including, on the side of case 12, a curved inner face 34 complementary to the convex external peripheral wall 20 of case 12 located opposite.

In order to simplify the diagram and facilitate comprehension, FIGS. 2 to 7 show only middle part 16 of case 12 and a single insert 30, without showing the whole of wristband 14.

Each end strand 26, 28 of wristband 14 includes two horns 35, 37 which are fixed to insert 30 and which give the watch a conventional appearance, Each insert 30 includes, around the pivoting axis A1 thereof, two indexed angular positions, relative to case 12, which correspond respectively to two positions of use of case 12, i.e. a right position P1 wherein the right side F1 is oriented upwards, and a reverse position P2 wherein the reverse side F2 is oriented upwards.

Each insert 30 includes, along the pivoting axis A1 thereof, a longitudinal rest position Pr wherein insert 30 is blocked from pivoting by a male element 36 fitting inside a female element 38, and a longitudinal pivoting position Pp wherein insert 30 is shifted longitudinally outwards, relative to case 12, and wherein insert 30 is free to pivot relative to case 12.

According to the embodiment shown, the male element 36 is made integral with case 12 in the form of a rib 36 of substantially rectangular longitudinal section arranged on the outer peripheral wall 20 of case 12. Rib 36 thus forms an extra thick strip which follows the radius of curvature of the external peripheral wall 20 of case 12. The female element 38 is made in the form of a complementary groove 38 of rib 36 arranged in the inner face 34 of insert 30.

Figure 3:
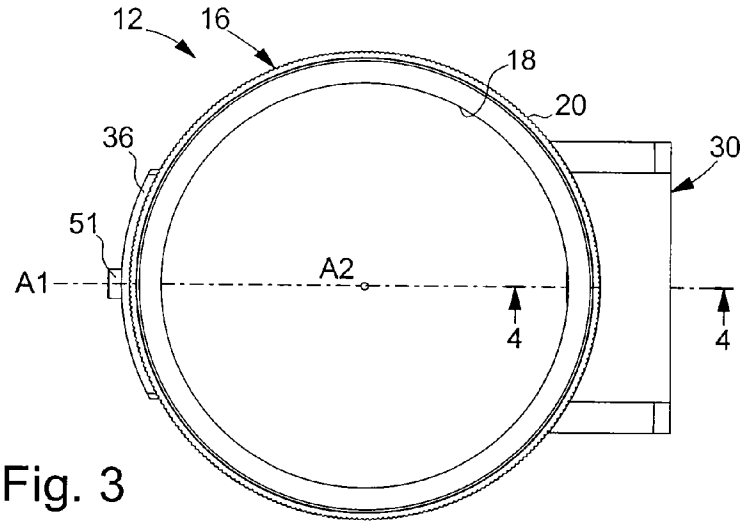
FIG. 3 is a top view that shows schematically the case of the wristwatch and an associated insert in the rest position.
Figure 4:
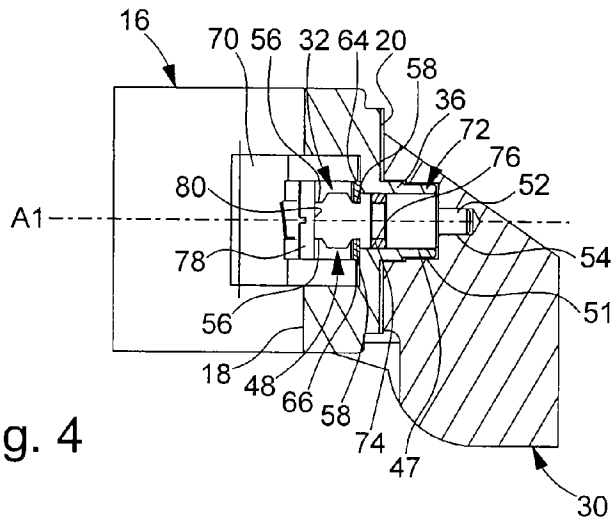
FIG. 4 is a partial longitudinal cross-section 6-6 that shows the pivoting and indexing device in the rest position.

In the rest position Pr as shown in FIGS. 1, 3 and 4, the top transverse edge 40 of groove 38 is substantially adjacent to the top transverse face 42 of rib 36 and the bottom transverse edge 44 of groove 38 is substantially adjacent to the bottom transverse face 46 of rib 36, which prevents any pivoting of insert 30 relative to case 12.

Figure 5:
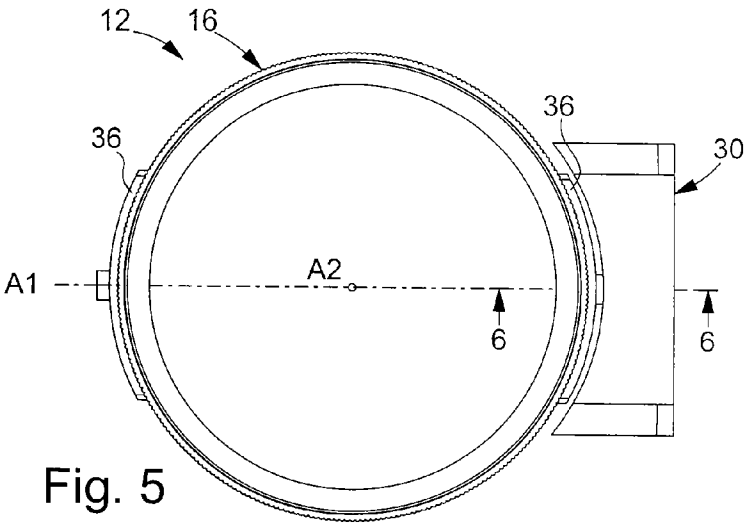
FIG. 5 is a similar view to that of FIG. 3 that shows the pivoting and indexing device in the pivoting position.
Figure 6:
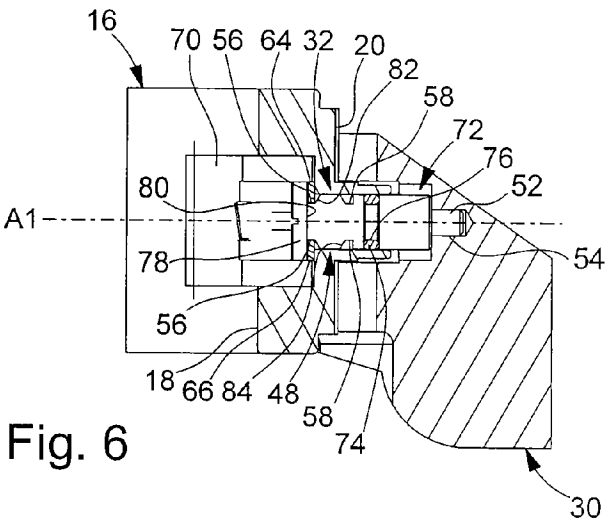
FIG. 6 is a similar view to that of FIG. 4 that shows the pivoting and indexing device in the pivoting position.
Figure 7:
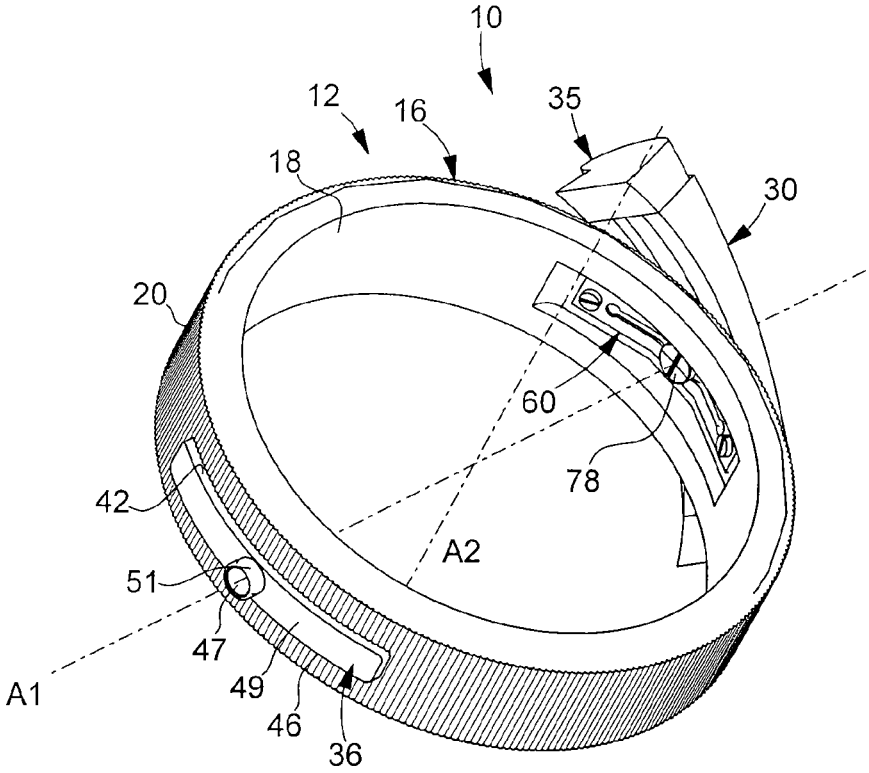
FIG. 7 is a perspective view that shows schematically an insert in an intermediate angular position as it pivots relative to the wristwatch case.

In the pivoting position Pp as shown in FIGS. 5 to 7, insert 30 is longitudinally shifted towards the exterior so that rib 36 is released from groove 38 thereby allowing the pivoting of insert 30 with respect to case 12.

Trunnion 32 extends here through rib 36, in a longitudinal guide conduit 47 which opens out, on one side, into the inner wall 18 of middle part 16 and, on the other side, into the external transverse face 49 of rib 36 via a collar 51.

In accordance with the teaching of the invention, each trunnion 32 includes a first indexing element 48, which cooperates with a second indexing element 50 arranged on case 12 so as to index the associated insert 30 respectively in rest position Pr and in pivoting position Pp.

Trunnion 32 will now be described when the associated insert 30 is occupying rest position Pr.

According to an advantageous embodiment, trunnion 32 includes, at the outer end thereof, a longitudinal securing section 52, which is fixed in insert 30. Securing section 52 is formed here by a longitudinal threaded pin 52, which is screwed into a complementary threaded hole 54 arranged in insert 30. Trunnion 32 includes, at the inner end thereof, a cylindrical indexing section 48, which forms the first indexing element 48 and which extends longitudinally inside case 12. Indexing section 48 includes two inner transverse notches 56 which are parallel and diametrically opposite along a vertical direction, relative to pivoting axis A1, and two outer transverse notches 58, which are parallel and diametrically opposite along a vertical direction, relative to pivoting axis A1. The two inner notches 56 are thus shifted longitudinally relative to the two outer notches 58.

An elastically deformable plate 60 is fixed to middle part 16 inside case 12. The plate 60 extends overall in a transverse plane perpendicular to the longitudinal direction A1. It includes a transverse slot 62, which delimits a top strip 64 and a bottom strip 66 provided for engaging in the bottom of notches 56, 58 of indexing section 48 when insert 30 is occupying an indexed longitudinal position Pr, Pp. Strips 64, 66 thus form the second indexing element 50 arranged on case 12. In rest position Pr, the top and bottom strips 64, 66 are engaged in external notches 58 and, in the pivoting position, strips 64, 66 are engaged in inner notches 56. Each strip 64, 66 includes, on the side of transverse slot 62, a flat transverse edge 65, 57 which is provided for abutting in the flat bottom of the associated notch 56, 58 in each indexed longitudinal position Pr, Pp.

The transverse slot 62 is provided for opening when indexing section 48 of trunnion 32 slides longitudinally between the two longitudinal positions thereof Pr, Pp. Plate 60 is deformed elastically allowing top strip 64 and bottom strip 66 to move away from each other.

Plate 60 is fixed to case 12 by the transverse ends thereof, here by means of two securing screws 68. It is fixed in the bottom of an inner groove 70 which is arranged in the inner peripheral wall 18 of middle part 16 and which thus forms a housing for plate 60.

Preferably, trunnion 32 includes a cylindrical guide section 72, which extends at least partially inside guide conduit 47, whatever indexed position insert 30 is occupying, and which is inserted between indexing section 48 and securing section 52. Moreover, trunnion 32 includes an O-ring sealing gasket 74, which is mounted in an annular peripheral groove 76 inserted longitudinally between indexing section 48 and guide section 72.

Advantageously, the external diameter of indexing section 48 and the external diameter of guide section 72 are substantially equal to the internal diameter of guide conduit 47 so as to guide trunnion 32 as it slides longitudinally.

According to the embodiment shown, a stop screw 78 is screwed to the external axial end of trunnion 32. The external face 80 of the head of stop screw 78 delimits one side of each outer notch 56. The external diameter of the head of stop screw 78 is greater than the external diameter of trunnion 32 which prevents trunnion 32 from sliding longitudinally outwards beyond the pivoting position Pp thereof.

The operation of wristwatch 10 according to the invention is as follows. From the rest position Pr, shown in FIGS. 1, 3 and 4, the user pulls longitudinally on each insert 30, while holding case 12, so as to slide trunnion 32 outwards into its guide conduit 47. Via the longitudinal effort exerted by trunnion 32 against strips 64, 66, strips 64, 66 move apart by deforming elastically then return to their initial rest state by engaging in the associated inner notches 56, which corresponds to the longitudinal pivoting position Pp shown in FIGS. 5 and 6.

Advantageously, each notches 56, 58 of indexing section 48 includes, on the side of the opposite notch 56, 58 on inclined wall 82, 84 forming a control surface which facilitates the deformation of strips 64, 66.

In pivoting position Pp, groove 38 is released from rib 36 such that insert 30 is no longer blocked from pivoting, which enables the user to pivot case 12 about pivoting axis A1 by a half a turn, from the right angular position P1 to the reverse angular position P2, reversing the two faces F1, F2 of case 12 and presenting the reverse side F2 upwards. During pivoting, strips 64, 66 deform elastically again as they leave inner notches 56, the maximum deformation being a pivoting movement through a quarter turn, then they return to their initial shape by engaging again in the associated inner notches 56. An intermediate angular position between the right position P1 and the reverse position P1 is shown by way of example in FIG. 7.

When the pivoting through a half turn is completed, the user pushes each insert 30 back against case 12, sliding trunnion 32 axially inwards, into the guide conduit 47 thereof, until strips 64, 66 are received in the outer notches 58 and rib 36 engages in groove 38, which is the rest position Pr of insert 30.

Of course, pivoting can occur here in both directions and passage from the reverse position P2 to the right position P1 occurs in the same way as previously described.

It will be noted that the longitudinal indexing obtained due to indexing section 48 of trunnion 32 and to deformable plate 60 is independent of the angular blocking obtained due to the nested fitting of rib 36 in groove 38. Thus, manipulation of case 12 and inserts 30 is simplified, and the relative movements of each insert 30 relative to case 12 are more precise and more reliable since they are perfectly delimited by the cooperation of indexing section 48 with deformable plate 60.

It will also be noted that, in addition to longitudinal indexing, the cooperation of indexing section 48 with deformable plate 60 provides angular indexing. Indeed, during the relative pivoting of an insert 30 relative to case 12, the passage from one indexed angular position P1, P2 to an intermediate angular position, like that shown in FIG. 7, is felt by the user because of the elastic deformation of strips 64, 66 which tend to return trunnion 32 and insert 30 to a stable angular position, i.e. either towards the right position P1, or towards the reverse position P2.

What is claimed is:

1. A wristwatch including a wristband and a reversible case, which contains at least one watch movement, wherein each end strand of the wristband includes an insert, which is pivotably and slidably mounted on the case via a longitudinal trunnion, along the direction of the wristband, and wherein each insert includes at least two angular indexed positions, relative to the case, which respectively correspond to two positions of use of the case, and at least two longitudinal positions, which are:

a longitudinal rest position wherein the insert is blocked from pivoting by a male element fitting into a female element, one of the elements being arranged on the case, the other element being arranged on the insert, and a longitudinal pivoting position wherein the insert is shifted longitudinally outwards, relative to the case, and wherein the insert is free to pivot relative to the case, wherein each trunnion includes a first longitudinal indexing element which cooperates with a second longitudinal indexing element arranged on the case so as to index the associated insert respectively in the rest position and the pivoting position.

2. The wristwatch according to claim 1, wherein the trunnion includes a securing section, which is fixed in the insert and a cylindrical indexing section, which extends longitudinally inside the case and which includes at least one first and one second transverse longitudinally shifted notches which cooperate by nested fitting with at least one elastically deformable strip fixed inside the case so as to index the associated insert respectively in the rest position and in the pivoting position.

3. The wristwatch according to claim 2, wherein the case includes a plate that extends overall in a transverse plane perpendicular to the longitudinal direction, and wherein the plate is fixed to the case via the transverse ends thereof, and wherein the plate includes a transverse slot, which delimits first and second deformable strips, at least one strip being received in one of the two notches when the insert is occupying an indexed position.

4. The wristwatch according to claim 3, wherein the indexing section includes, for each longitudinal indexed position, a top notch and a bottom notch which are diametrically opposite and which each receive an associated strip when the insert is occupying the corresponding indexed position.

5. The wristwatch according to claim 3, wherein the plate is fixed in a groove arranged in the inner face of the middle part of the case.

6. The wristwatch according to claim 1, further comprising a nested fitting element, integral with the case, and arranged on the case to lock the insert by nested fitting.

7. The wristwatch according to claim 6, wherein the nested fitting element is the male element made integral with the case in the form of a rib arranged on an external peripheral face of the case, and fits nestedly with the female element made in the form of a complementary groove arranged in a face of the insert located opposite the case.

8. The wristwatch according to claim 7, wherein the cross-section of the rib is substantially rectangular.

9. The wristwatch according to claim 1, wherein the case includes a cylindrical longitudinal guide conduit, whose diameter is substantially equal to the external diameter of the trunnion and which guides the trunnion as it slides longitudinally.

10. The wristwatch according to claim 9, wherein the trunnion includes a cylindrical guide section which extends at least partially inside the guide conduit, whatever indexing position the insert is occupying.

11. The wristwatch according to claim 10, wherein the trunnion includes a sealing gasket that is mounted in a peripheral annular groove inserted longitudinally between the guide section and the indexing section.

12. The wristwatch according to claim 7, wherein wherein the case includes a cylindrical longitudinal guide conduit, whose diameter is substantially equal to the external diameter of the trunnion and which guides the trunnion as it slides longitudinally, and wherein the guide conduit extend through the male element.

13. The wristwatch according to claim 1, wherein each end strand of the wristband includes two horns which are fixed to the insert.

14. The wristwatch according to claim 4, wherein the plate is fixed in a groove arranged in the inner face of the middle part of the case.

* * * * *